United States Patent [19]

Chaplick

[11] 4,080,680

[45] Mar. 28, 1978

[54] METHOD FOR STIFFENING SHOE UPPERS

[75] Inventor: Adolph Michael Chaplick, Hudson, N.H.

[73] Assignee: USM Corporation, Boston, Mass.

[21] Appl. No.: 702,870

[22] Filed: Jul. 2, 1976

[51] Int. Cl.[2] ..... A43D 87/00; B05B 3/02

[52] U.S. Cl. ..... 12/146 D; 427/389; 428/241; 428/325

[58] Field of Search ..... 427/389; 428/241, 325; 12/146 D

[56] References Cited

U.S. PATENT DOCUMENTS

| | | | |
|---|---|---|---|
| 3,316,139 | 4/1967 | Alford et al. | 428/241 X |
| 3,316,573 | 5/1967 | Chaplick et al. | 12/146 |

OTHER PUBLICATIONS

Solid Glass Spheres, Potters Industries, Inc.
Spherical Glass Fillers, Otto R. Strauch, 1969, Potters Industries, Inc.
Sphere-Filled Plastic Composites Theory, Testing, Applications, Potters Industries, Inc.

*Primary Examiner*—Michael R. Lusignan
*Attorney, Agent, or Firm*—Benjamin C. Pollard; Richard B. Megley; Vincent A. White

[57] ABSTRACT

Stiffening method in which the strength, stiffness and application properties of thermoplastic synthetic polymer resin stiffening material are improved through combination with the resin of controlled proportions of glass microspheres and the composition is applied as a layer in molten condition on the portion of a shoe upper to be stiffened and is hardened by cooling.

5 Claims, 2 Drawing Figures

METHOD FOR STIFFENING SHOE UPPERS

FIELD OF THE INVENTION

The present invention relates to a method for stiffening sheet material particularly for stiffening selected areas of shoe components.

BACKGROUND OF THE INVENTION

Thermoplastic resinous material has been melted and applied as a thin layer to sheet material such as shoe parts and cooled to provide a resilient stiff layer. This procedure is shown for use in stiffening the toe and counter portions of a shoe upper in the U.S. Patent to Chaplick et al. U.S. Pat. No. 3,316,573 issued May 2, 1967. The stiffening has been found effective to insure shape retention of the sheet material such as shoe parts with which the resinous material is associated. However, particularly with heavier shoes or boots, greater strength and stiffness has been desired.

SUMMARY OF THE INVENTION

It is an object of the present invention to provide a method particularly for shoe components in which the advantages of the hot melt stiffening system are retained but in which there is formed a stiffened component having greater stiffness and strength under bending stress.

To this end and in accordance with a feature of the present invention, I have provided a stiffening method in which the strength, stiffness of thermoplastic synthetic polymer resin stiffening material are improved through combination with the resin of controlled proportions of glass microspheres.

THE DRAWINGS

The invention will be described in connection with the drawings in which:

FIG. 1 is an elevational view, partly in section showing application of a layer of molten stiffening material on a shoe part and the relation of the stiffening material to the shoe part after application; and FIG. 2 is an elevational view with parts broken away showing the application of a second layer of a shoe to the layer of stiffening material and the relation of the shoe part, stiffening material and second layer of the shoe.

DETAILED DESCRIPTION

In the following disclosure, the invention will be described in connection with the stiffening of shoe parts, particularly shoe counters and box toes. It will be understood that the invention is useful in other relations involving the application of stiffening material in molten form.

Figure 1:
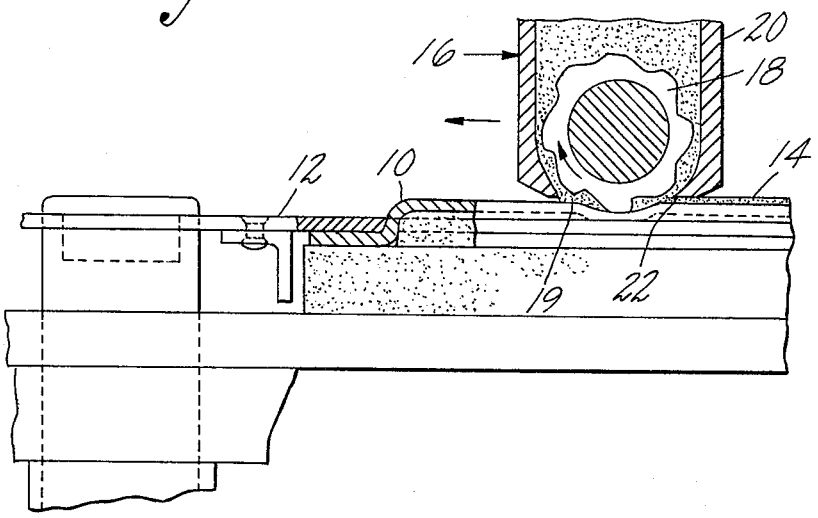

As shown in FIG. 1, the first step of the method is application to the areas to be stiffened of a coating of the stiffening composition in molten condition. The area to be stiffened shown as the toe portion 10 of a shoe upper is mounted in a work holder 12 which supports it with the surface to be treated exposed and then a coating 14 of the stiffening composition in molten form is applied on the exposed surface of the area to be stiffened. Any suitable procedure may be used for applying molten material. Thus, the molten material may be spread over the area by hand, using a spatula. Preferably, the coating is carried out using a known mechanical applicator device 16 such as that shown in U.S. Pat. No. 3,316,573 to Chaplick and Rossitto dated May 2, 1967 including rotating applicator wheel 18 disposed in the otherwise open lower end 19 of a heated chamber 20 containing the molten stiffener material. The molten material is spread by the applicator wheel 18 in wetting adhesive engagement with the exposed surface of the area to be stiffened and a metering blade 22, which may be at the lower edge of the chamber 20 determines the thickness of the applied coating 14. The coating thickness may be from about 0.010 inch to about 0.050 inch, preferably from about 0.025 inch to about 0.040 inch. Reference is made to the above patent for a more complete description of the work holder 12, applicator 16 and application procedure.

The improved stiffening composition of the present invention is a uniform mixture of normally stiff, resilient, synthetic polymeric material and tiny glass beads or spheres in a special range of relative proportions in which the composition both retains cohesiveness in molten condition which enables it to be spread as a thin continuous layer on a part to be stiffened and is strong, stiff, and crack-resistant after shaping and solidification.

A wide variety of heat softenable synthetic polymeric resinous materials may be used in the present process. These materials may be either permanently thermoplastic or may be heat softenable and converted by heat or other means to a higher melting or infusible condition. Among useful materials are the polyesters and copolyesters, polyamides and copolyamides, polyesteramides, polyvinyl compounds such as polystyrenes, polyvinyl acetate and so on. For combination with glass beads or spheres in the present stiffener composition, it is preferred to use resinous materials having a melt viscosity at 180° C. of between about 15,000 and about 90,000 cps. as determined on the Brookfield Thermosel Viscometer using a #27 spindle. U.S. Pat. No. 3,316,573, above referred to, provides a fuller description of polymeric materials including preferred ranges of softening points and application temperatures useful for forming the stiffener coatings in the present method and the disclosure of that patent is incorporated by reference.

The glass beads or spheres used in combination with the polymeric material are smooth surfaced regular spheres having a size of preferably less than about 325 mesh, U.S. Standard Sieve and preferably have an average sphere diameter of about 30 microns. To secure best cooperation with the polymeric material of the stiffening composition, it is preferred that the spheres be coated with a coupling agent, such as an organo-silane material, known to improve the adhesion between glass and resinous materials.

The stiffness and strength of the stiffener layer in a shoe increases with increasing percentages of the glass beads or spheres and is effective to give useful stiffness and strength together with cohesiveness and suitably low viscosity in molten condition for spreading where the composition includes from about 10 to about 50% by weight of the glass spheres based on the weight of the composition. It has been found, however, that degradation of the polymeric material in the applicator tends to occur at the higher end of this range of percentage of glass beads and it is preferred to use a percentage of glass beads in the range of from about 20 to about 40%. It is noted that the glass beads, because of their generally spherical state have relatively small effect on the viscosity of the polymeric material in molten condition as compared with conventional irregular filler particles such as silica, mica or slate powder. That is, molten compositions containing 20 to 40% of the irregular surfaced filler materials would be stiff and non-spreadable under the melt application conditions used in stiffening shoes. Also, it appears that the presence of the beads does not interfere with adhesive wetting of the part to be stiffened when the composition is applied with a wiping, spreading action.

Figure 2:
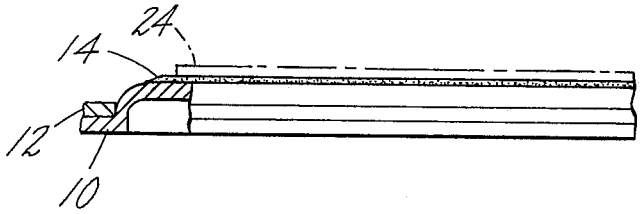

After application of the molten stiffener composition to the part to be stiffened, it is preferred as shown in FIG. 2, that a second flexible shoe part 24 for example, a doubler or lining be laid down on the stiffener coating 14 while that coating is in molten condition. Simple pressure such as has been used heretofore in connection with pressing a liner against a simple molten polymeric stiffener coating is effective to form a strong adhesive union between the present stiffener coating 14 and the lining or other shoe part 24 pressed against it.

After application of a coating 14, the stiffener material and pressing of the lining or other shoe part 24 against the coating, completion of the shoe may proceed essentially as in shoe making using the simple polymeric stiffener layer. The stiffened portion will ordinarily be heated to bring the shoe part to freely formable condition by steaming, radiant heat or other heating procedure and then the part is disposed around a last or other shape with application of tension to press the shoe upper into firm engagement with the last to shape the stiffener. On cooling, the joined layers of the shoe upper cooperate to give strength and resilient shape retaining stiffness.

The following examples are given as of assistance in understanding the invention; but it is to be understood that the invention is not limited to the particular materials, procedures, or conditions set forth in the examples.

EXAMPLE ONE

A polyamide resin was prepared from condensation of dimerized soy bean oil fatty acid, about 43 parts by weight, sebacic acid, 2 parts by weight, ethylene diamine, 4.3 parts by weight, and hexamethylene diamine (70%) 1.7 parts by weight, polymerization being carried out to give a ball and ring softening point of from about 260° F. to about 274° F. the resin having an acid value of from about 1.5 to about 2.5 mg. KOH/gm. and an amine value of from about 1.2 to about 1.4 mg KOH/gm. The resin melt viscosity at 180° C. using a Brookfield Thermosel Viscometer with a #27 spindle and a one half hour time, was in the range of from about 20,000 to about 25,000 cps.

A portion of this was coated on the toe portion of a shoe upper using the apparatus described above to form a coating 0.040 inches thick, application temperature being about 380° F. Directly after application of the coating while the coating was still soft, a fabric liner was laid down on the exposed surface of the coating and pressed to establish all over wetting engagement between the liner and the coating material.

A further portion of the resin was combined with an equal weight of fine glass spheres of a size to pass a 325 mesh screen (U.S. Standard Sieve) and carrying an organo-silane coating (beads commercially available from Potters Industries, Inc. under "Glass Reinforcements — Filler — Spheres No. 3,000").

A shoe lining was laid down on the coating of mixed material and pressed against the coating to bring it into wetting adhesive engagement with the coating as was done with the simple resin coating.

Each of the shoe uppers containing the stiffener coating materials was subjected to conventional steaming treatment as used in preparing shoe uppers for lasting, was mounted on a last and lasted. After lasting, soling, heeling and other operations were carried out and the shoes removed from the lasts. In each case the toe and heel portions conformed well to the last shape. However, the toe portion stiffened with the composition comprising resin and glass spheres was very much stiffer than that with the simple resin stiffener material.

EXAMPLE TWO

Pieces of shoe fabric upper material, thickness approximately 0.035 inch were coated with the unmodified resin of Example One and other pieces with the mixture of resin and glass spheres of Example One, using the same coating conditions and depositing a coating 0.040 inch in thickness in each case. After standing a week, test samples were die cut (1 × 3½inches) across the width of the coated material.

These samples were subjected to a stiffness test which involved placing the ends of the test samples in angled slits in spaced clamps holding the samples with a bowed configuration with the peak of the bow ⅝ inch above the level of the ends of the bow. A probe was then adjusted to touch the top of the sample and was moved downwardly against the bowed section at a rate of one inch per minute. Stiffness of the stiffened material was determined as pounds per inch by dividing force value in pounds reached in pressing down on the sample by the average thickness of the sample.

Samples stiffened with the sample resin averaged about 20 pounds per inch and samples stiffened with the resin containing the glass spheres averaged slightly more than 30 pounds per inch.

Having thus described my invention, what I claim as new and desire to secure by Letters Patent of the United States is:

1. In a method of stiffening selected areas of an end portion of a shoe upper including the steps of applying a coating of hot viscous molten synthetic polymeric material to the surfaces of said selected area, the synthetic polymeric material having a viscosity low enough to wet and adhere to said surface but sufficiently high that it will substantially not penetrate the material of said sheet and cooling the molten material to form a stiff resilient adherent layer; the improvement which consists in applying as said molten coating an intimate mixture of viscous molten thermoplastic synthetic polymeric material having a melt viscosity at 180° C. of from about 15,000 to about 90,000 cps. (as determined on a Brookfield Thermosel Viscometer) with a #27 spindle and ½ hour time and from about 10 to about 50% by weight based on the weight of said coating of solid glass spheres having diameters capable of passing a U.S. Sieve Number 325 said coating having a thickness of from about 0.010 to about 0.050 inches.

2. A method of stiffening an end portion of a shoe upper as defined in claim 1 in which said glass spheres have an average sphere diameter of about 30 microns and are present to the extent of from about 20 to about 40% by weight based on the weight of said coating.

3. The method of stiffening an end portion of a shoe upper as defined in claim 2 in which said molten coating is spread on an inner surface of an exterior layer of a shoe upper and in which an inner layer of a shoe upper is pressed against and adhered to said coating while said coating is in heat softened condition.

4. The method of stiffening an end portion of a shoe upper as defined in claim 3 in which said beads carry a coating of an organo-silane coupling agent and in which said molten coating is from about 0.025 to about 0.040 inches in thickness.

5. The method of stiffening an end portion of a shoe upper as defined in claim 4 in which heat is applied to the assembly of exterior layer, coating and inner layer to soften said coating and thereafter conforming pressure is applied to shape said shoe component around a form to impart the desired three-dimensional configuration after which said assembly is cooled to maintain said shoe portion in the configuration in which it was shaped.

* * * * *